US007058191B2

(12) United States Patent
Ballisager et al.

(10) Patent No.: US 7,058,191 B2
(45) Date of Patent: Jun. 6, 2006

(54) HEARING AID WITH A RADIO FREQUENCY RECEIVER

(75) Inventors: Lars Ballisager, Hellerup (DK); Bjarne Klemmensen, Hellerup (DK)

(73) Assignee: Oticon A/S, Smørum (DK)

( * ) Notice: Subject to any disclaimer, the term of this patent is extended or adjusted under 35 U.S.C. 154(b) by 151 days.

(21) Appl. No.: 10/381,694

(22) PCT Filed: Oct. 4, 2001

(86) PCT No.: PCT/DK01/00648

§ 371 (c)(1),
(2), (4) Date: Mar. 27, 2003

(87) PCT Pub. No.: WO02/30154

PCT Pub. Date: Apr. 11, 2002

(65) Prior Publication Data

US 2004/0022403 A1 Feb. 5, 2004

(30) Foreign Application Priority Data

Oct. 4, 2000 (DK) ..... 2000 01478

(51) Int. Cl.
*H04R 25/00* (2006.01)

(52) U.S. Cl. ..... 381/312; 381/315

(58) Field of Classification Search ..... 381/23.1, 381/312, 314, 315, 316, 320–323; 455/150.1, 455/154.1, 154.2, 161.1, 161.3, 260, 264, 455/265, 255, 76

See application file for complete search history.

(56) References Cited

U.S. PATENT DOCUMENTS

| | | | | |
|---|---|---|---|---|
| 4,088,959 A | | 5/1978 | Sumi | 455/180.1 |
| 4,538,136 A | | 8/1985 | Drabing | 340/310.02 |
| 5,721,783 A | * | 2/1998 | Anderson | 381/328 |
| 5,751,820 A | * | 5/1998 | Taenzer | 381/312 |
| 5,802,183 A | | 9/1998 | Scheller et al. | 381/322 |
| 6,240,194 B1 | | 5/2001 | DeKoning | |

FOREIGN PATENT DOCUMENTS

| | | |
|---|---|---|
| EP | 0578020 | 1/1994 |
| EP | 1113582 | 7/2001 |
| JP | 11069495 | 3/1999 |

* cited by examiner

*Primary Examiner*—Huyen D. Le
(74) *Attorney, Agent, or Firm*—Dykema Gossett PLLC

(57) ABSTRACT

A hearing aid including a radio frequency receiver, where the receiver includes a single oscillator providing a single crystal oscillator frequency and where means are provided for generating a further number of receiving frequencies by transforming the oscillator frequency to the desired receiving frequencies, where further scanning means are provided for upon activation provide a scanning of the possible frequency area and select a detected frequency superceding a predetermined detector level.

5 Claims, 4 Drawing Sheets

HEARING AID WITH A RADIO FREQUENCY RECEIVER

AREA OF THE INVENTION

The invention relates to the area of hearing aids comprising a radio frequency receiver. The receiver may be a built in receiver or an external receiver attached to the hearing aid by suitable means.

BACKGROUND OF THE INVENTION

One example of a hearing aid with a RF receiver is disclosed in CH 641619. The hearing aid with a RF receiver shown in this prior art document and other similar products available on the market today all comprise a single frequency receiving possibility. From U.S. Pat. No. 5,802,183 a further hearing aid is known which comprises the possibility of shifting between two frequencies, due to the presence of two crystals for determining the receiving frequency. In all of these previously known devices the frequency may be changed by changing the crystal element present for determining the receiving frequency. The very limited space available in such devices makes it difficult and often even impossible to incorporate a number of crystals corresponding to the desired receiving frequencies.

The change of a crystal is rather difficult due to the small size of these elements and the process is rather time consuming. Furthermore an amount of crystals corresponding to the number of desired frequencies is required for making the system operative under all desired circumstances. The device known from U.S. Pat. No. 5,802,183 offers the possibility of having two crystals and a switch for switching between the two frequencies. When however a larger number of frequencies is desired the same problem as described above exists.

The objective of the present invention is to provide a device, which offers the possibility of shifting between a larger number of frequencies than previously known, in a more efficient and less time consuming manner. A further objective is to provide a separate element, which in connection with a hearing device provides these same advantages.

SUMMARY OF THE INVENTION

The objective of the invention is achieved by means of a hearing aid as defined in claim 1.

By means of the defined construction it is possible to realize an increased number of possible receiving frequencies in the very limited available space of a hearing aid and the selection of the desired receiving frequency may be achieved simply by tuning into the frequency by means of the auto selector means which upon activation will scan the frequency band until a frequency is detected having a level superceding a predetermined border level.

By the embodiments defined in the claims the possibility of providing a switch in the hearing aid housing enclosing the receiver in a separate element, which together with the separate hearing aid constitutes the unit. By providing switch means in the separate element it is ensured that the receiver contained in this separate element always will be operable in connection with an existing hearing aid on which it is mounted.

When a switch is provided on the hearing aid for activating the selector means and when the selector means are adapted for scanning until the next frequency upon an activating pressure of a duration less than a predetermined max duration a possibility of easy channel selection is achieved, which is very important for especially elderly hearing aid users, whom may have difficulties handling the relatively small components of a hearing aid. The same counts for the unit and the method defined in the claims.

Further advantageous is it when a switch is provided on the hearing aid for activating the selector means, and where the selector means are adapted to, upon registration of an activation pressure having a duration above a predetermined duration level, to continue the scanning until the next frequency superceding the predetermined detector level.

Hereby the channel selection is further facilitated and at the same time swift. The same counts for the unit and the method defined in the claims. A limiter may be provided stopping the scanning in case no signal level is detected after a predetermined number of runs through the frequency range.

The invention will be explained more detailed in the following description of a preferred embodiment, with reference to the drawing.

DESCRIPTION OF A PREFERRED EMBODIMENT

The analog RF signal is picked up by an antenna, which is connected to the on-chip LNA through an external matching network. The matching network is needed to make the RF receiver flexible towards different types of antennas, and to keep the current consumption down in the LNA.

Figure 1:
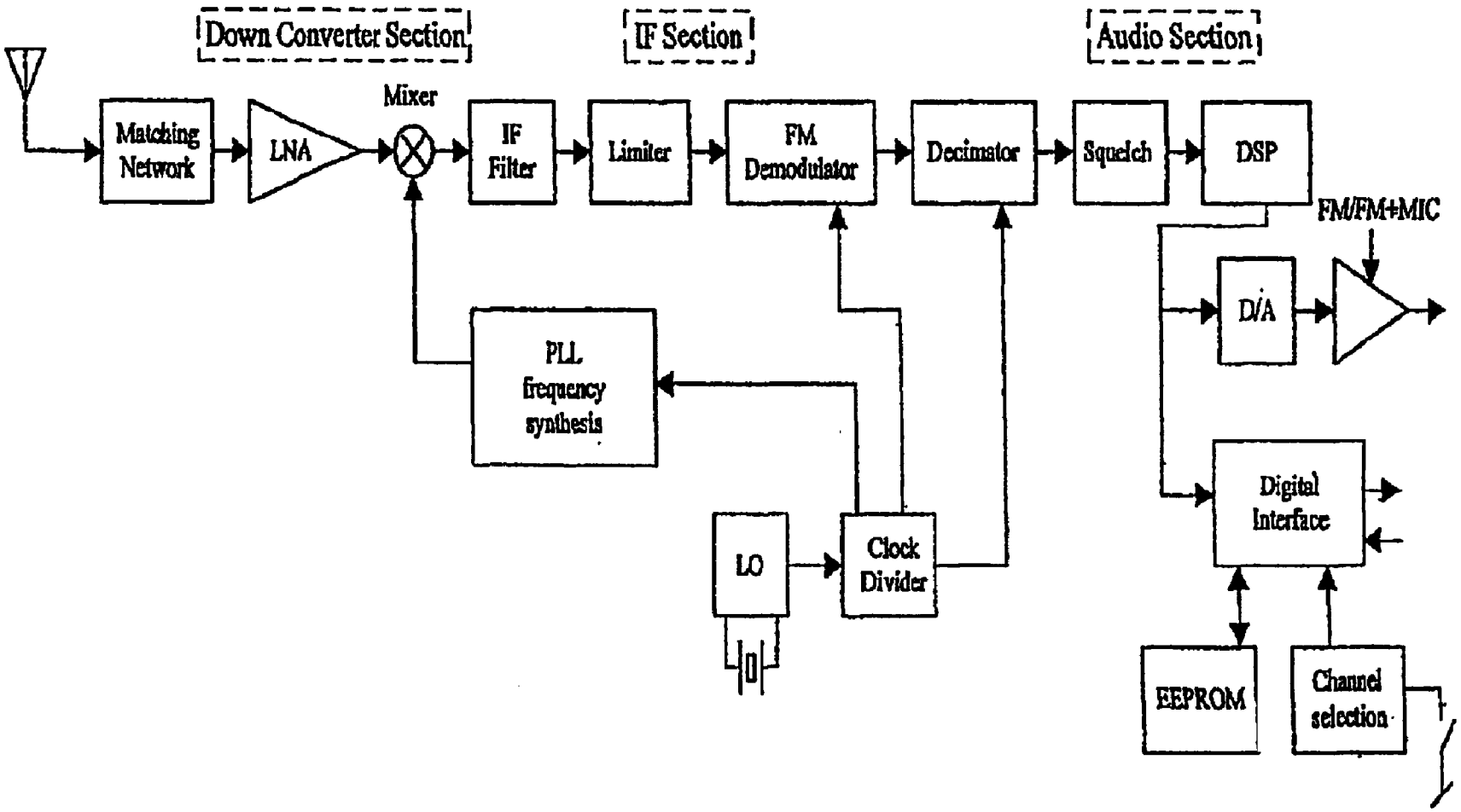
FIG. 1 is a simplified circuit diagram showing a module intended for connection to a hearing device.
Figure 2:
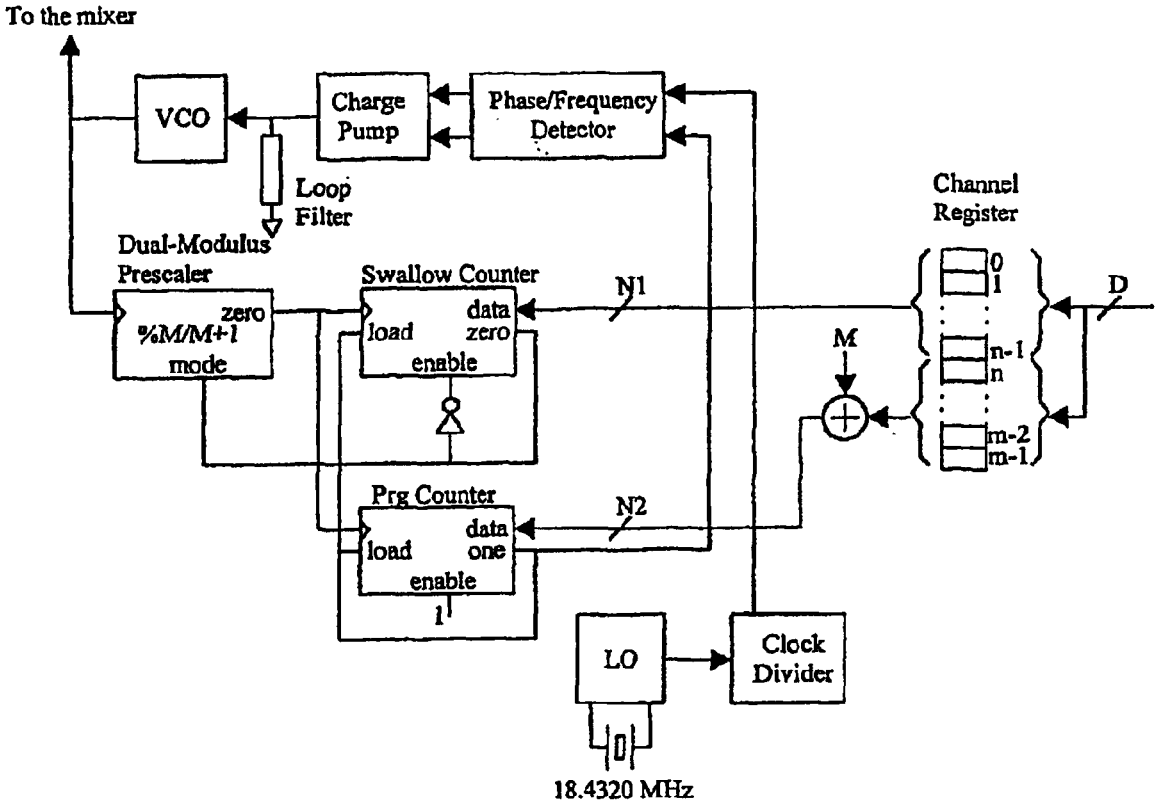
FIG. 2 is a simplified circuit diagram showing the frequency synthesizer part of the module of FIG. 1.
Figure 3:
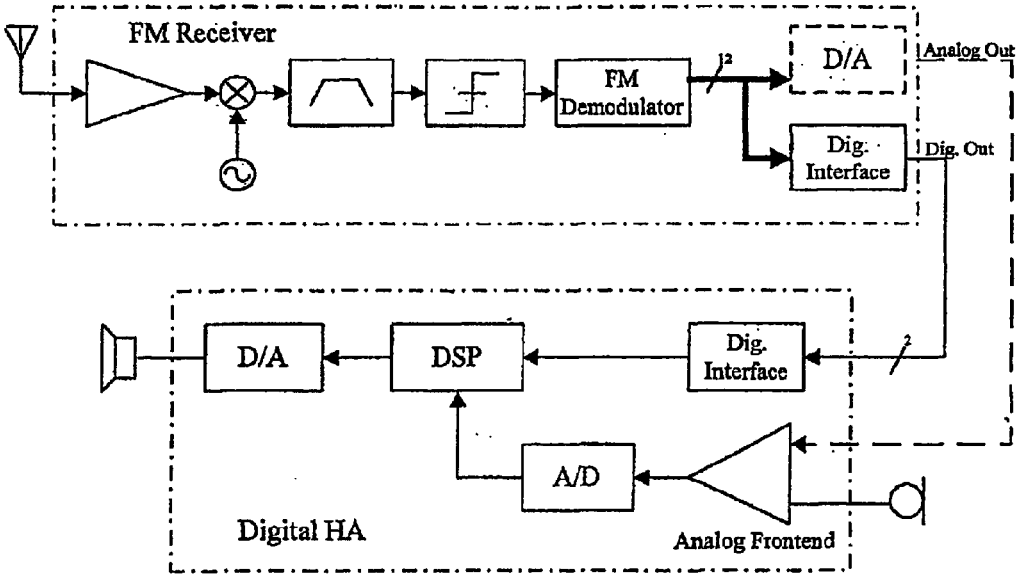
FIG. 3 is a simplified circuit diagram showing the interface between a module as shown in FIG. 1 with a hearing device.
Figure 4:
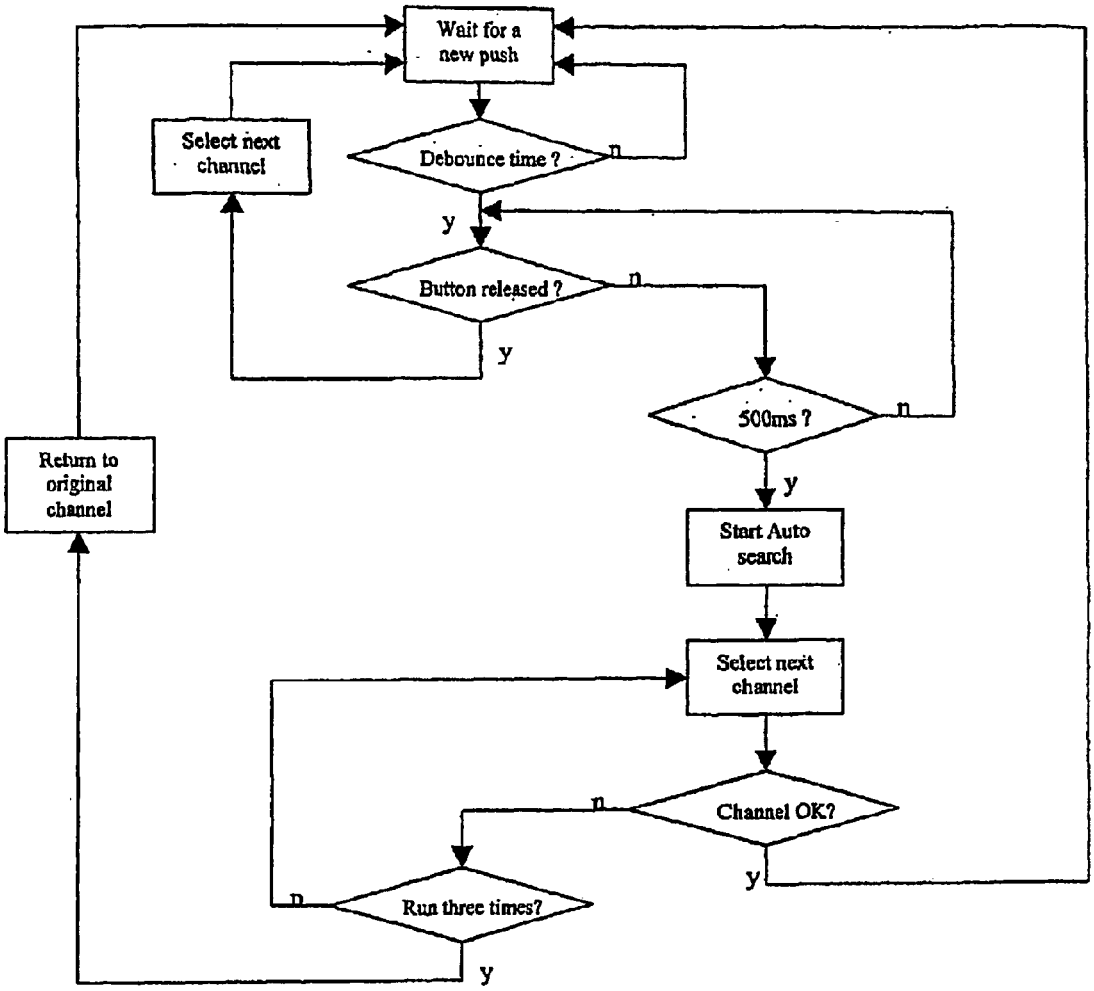
FIG. 4 is a diagram showing the implementation of the method according to the invention.

The LNA (Low Noise Amplifier) is used to amplify the weak signal, which is picked up on the antenna Low noise is essential due to the low signal level at the input. The LNA wires the signal on to the mixer, which as the second input gets the desired channel frequency from the frequency synthesizer. The frequency synthesis system is described further in connection with FIG. 2.

The mixer mixes the signal down to an intermediate frequency (IF) of 35 KHz, which is the lowest intermediate frequency acceptable with the given audio bandwidth and frequency deviation. To support the wide range of synthesisable frequencies, the mixer and LNA needs wide operating conditions with regards to input frequencies.

The IF filter is used to separate the wanted channel. A steep filter is needed to obtain the wanted selectivity and properly suppress undesired signal in adjacent channels. Following the IF filter the limiter is the block with most of the gain. The IF signal is boosted and the analog signal is transformed to digital signal levels using a hard-clipping comparator.

The fully digital demodulator is based on a time detection scheme, which detects the zero-crossing of the IF signal. The demodulator is followed by a decimator that transforms the high frequency single bit signal to a 12 bit signal at a sampling frequency of 24 kHz. All signal processing of the demodulated signal is made by use of digital signal processing.

Two output solutions are available from the audio section. For older hearing aid (HA) styles, the audio signal is applied to the on-chip AD converter, and a traditional HA accessory interface system with output impedance adjustment is used to control the output level of the FM receiver.

For new advanced hearing aids, the receiver offers a fully digital audio output, and thereby a fully digital interface between the two systems. The interface is controlled by a derived IIC protocol, which is a true two-wire protocol. By transferring the audio and control signals digital, we get a much more reliable connection. In general, a digital interface is much less sensitive to bad contacts, noise, hum, moisture, dirt etc.

By passing the demodulated RF signal through the digital interface on the HA, the frontend can be bypassed. This means that signal-to-noise ratio is not lost in the first critical analog blocks. Besides this, the digital interface increases the flexibility in signal treatment compared to the traditional input parallel to the microphone. The signal level can easily be individually adjusted to fit the microphone input, and if needed different frequency characteristics can be applied.

By adding frequency synthesis, the user will only need one crystal, which is mounted at the factory. Within the given frequency bands the user chooses the pre-programmed channels via the channel selection interface. In other words the user has access to more than one channel without changing crystal, and the logistics are eased with only one version per band instead of having one crystal per channel.

The frequency synthesis will enable the use of the RF receiver in more applications than today: Stadiums, concert halls, churches etc. At a conference the user will be able to e.g. switch between different languages by changing channel, and if the system is used one on one, the user can change channel to avoid annoying interference, which might prove useful at e.g. dinner parties.

The frequency synthesis is built around a traditional phase locked loop (PLL). The wanted channel is set up using a 16 bit digital code, which is loaded from the attached EEPROM. Depending of the used reference frequency, the step size, and thereby the range and accuracy can be adjusted. With e.g. a 5 kHz step size, the range from 70 to 250 MHz is covered using only one crystal.

The VCO generates the high frequency waveform needed to match the wanted channels. The output frequency is controlled by a control voltage, which is generated by an attached charge pump. To obtain the needed accuracy the charge pump has a built-in voltage multiplier, which is used to widen the control voltage range. The control voltage and thereby the frequency is stepped up and down by the phase/frequency detector. The detector compares the divided output with the reference frequency (which determines the step size).

Depending on the applied control word, different start values are set up in the counters in the dividers. According to these values the division ratio is adjusted to obtain the wanted frequency (channel). For high frequencies the division ratio needs to be high to obtain the stable situation when the input for the phase/frequency detector matches the reference frequency locking the PLL.

The frequency synthesis makes it possible for the user to change channel without changing crystal. The user channel selection is done by use of a push button. The simplest use of a push button is a sequence of channels, where the next channel is chosen by a push. Another use of the push button solution is auto search. When the button is pushed, the pre-programmed channels are flicked through looking for activity. The first available channel, with enough signal strength, is then chosen. If more channels fulfil the demands, this function will switch between these when the button is pushed.

The two push button functions are easily combined. A short push will choose the next channel, whereas a long push will enable the auto search. This combination is well known from e.g. car radios. At power up the device will remember the latest used channel.

The user interface can be disabled for fixed channel devices and the two push button functions can be enabled/disabled independently. To enable a new search, the button must be released and pushed again. If no channels are found, the auto search routine will stop after three passes.

When a short push is detected, the switch interface sends a request for the EEPROM controller to change channel. This is done once for every push. When the auto search is enabled, the same request is send to the controller, but when the next channel is selected, a check is made to see, if this channel lives up to the required signal strength. The squelch circuit is used for the auto search criteria. If the selected channel is "squelched", a new request is sent, and the next channel in line is selected. This is done until an active channel is found, or until the channel sequence has been tested three times. A separate squelch level is used for the auto search to refine the search criteria.

When a new channel code is read in the EEPROM, this address is at the same time written to the ROM as being the active channel. This is necessary for the memory of latest used channel.

The implementation of frequency synthesis makes it possible for the user of a hearing aid to change channel without changing crystal. The user channel selection is done by use of a push button. The simplest use of a push button is a sequence of channels, where the next channel is chosen by a push. This is basically the functionality know from several hearing aids (M/MT/T).

Another use of the push button solution is auto search. When the button is pushed, the pre-programmed channels are flicked through looking for activity. The first available channel, with enough signal strength, is then chosen. If more channels fulfil the demands, this function will switch between these when the button is pushed. The two push button functions are combined. A short push will choose the next channel, whereas a long push will enable the auto search. At power up the device will remember the latest used channel.

The user interface may be disabled for fixed channel devices. Furthermore the two push button functions may be enabled/disabled independently.

The auto search requires a second user option with the same button. In the traditional push button interface a debounce time of 20–30 ms is used to prevent flicker. The next pre-programmed channel is selected when the button is released. The timing circuit must be extended to include enabling of the auto search after a push of 300 to 500 ms. The auto search will then search for the next channel and stop. To enable a new search, the button must be released and pushed again. If no channels are found, the auto search routine will stop after three passes.

When a short push is detected, the switch interface sends a request for the EEPROM controller to change channel. This is done once for every push. When the auto search is enabled, the same request is send to the controller, but when the next channel is selected, a check is made to see, if this channel lives up to the required signal strength. The squelch circuit is used for the auto search criteria. If the selected channel is "squelched", a new request is sent, and the next channel in line is selected. This is done until an active channel is found, or until the channel sequence has been tested three times. A separate squelch level is used for the autosearch to refine the search criteria. When a new channel code is read in the EEPROM, this address is at the same time written to the ROM as being the active channel. This is necessary for the memory of latest used channel. If only a few channels are programmed, a stop code is added to the following address. If e.g. only 4 channels are used the stop code is added as the channel 5 code for the EEPROM controller to know when to start over.

To enable the user to know when the channel is changed, a beep indication may be implemented as known in many hearing aids today. A single beep would indicate a normal channel change and two beeps would indicate the use of the auto search function. The beep will at the same time reveal an unintended channel change if the button is accidentally pushed.

The beep circuit can advantageously be disabled if not wanted. Besides that the beeps are programmable both with regards to frequency and volume.

What is claimed is:

1. A hearing aid comprising a radio frequency receiver, where the receiver comprises a single crystal oscillator providing a single oscillator frequency and where means are provided for generating a further number of receiving frequencies by transforming the oscillator frequency to a plurality of desired receiving frequencies, where a switch is provided on the hearing aid for activating further selector means, which upon activation provide a scanning of a possible frequency area and a selection of a detected frequency living up to a required signal strength.

2. A hearing aid according to claim 1, where the selector means are adapted for scanning until a next receiving frequency.

3. A hearing aid according to claim 2, where the selector means are adapted to, upon registration of an activation pressure having a duration above a predetermined max duration, to continue the scanning until the next frequency providing a signal living up to a required signal strength.

4. A method for selecting a frequency in the hearing aid as defined in claim 1, where the switch is provided on the hearing aid for activating the selector means for selecting a detected frequency living up to a required signal strength and where the selector means upon activation scans forward in a frequency range until a next receiving frequency.

5. A method according to claim 4, where the selector means upon registration of an activation having a duration above a predetermined duration, continues the scanning until a next frequency providing a signal living up to a required signal strength

* * * * *